US005086915A

United States Patent [19]

Yashima et al.

[11] Patent Number: 5,086,915

[45] Date of Patent: Feb. 11, 1992

[54] WRAPPING BODY FOR MEDICAL CONTAINER

[75] Inventors: Kenichi Yashima, Tokyo; Norisuke Kira; Yoshinori Minagawa, both of Fujinomiya, all of Japan

[73] Assignee: Terumo Kabushiki Kaisha, Tokyo, Japan

[21] Appl. No.: 499,458

[22] Filed: Jun. 18, 1990

[30] Foreign Application Priority Data

Dec. 19, 1987 [WO] PCT Int'l Appl. ...PCT/JP87/00998

[51] Int. Cl.[5] ..... B65D 81/26; F17G 11/00

[52] U.S. Cl. ..... 206/204; 206/438; 206/205

[58] Field of Search ..... 206/204, 205, 438

[56] References Cited

U.S. PATENT DOCUMENTS 4,497,406 2/1985 Takanashi ..... 206/438

FOREIGN PATENT DOCUMENTS 0093796 10/1982 European Pat. Off. .
2133540 4/1971 France .
58-192552 11/1983 Japan .
60-84561 6/1985 Japan .
61-5783 1/1986 Japan .

*Primary Examiner*—William I. Price
*Attorney, Agent, or Firm*—Frishauf, Holtz, Goodman & Woodward

[57] ABSTRACT

A plastic medical container which contains an infusion solution, such as a blood bag, is wrapped and sealed together with a deoxidizer in a flexible bag having retarded permeability to a gas and stream. The plastic medical container is in tight contact with and fixed by the flexible bag while being kept at a reduced pressure. The medical container is not moved in the wrapping bag during loading, and a tube connected to the medical container is not twisted. A moisture-absorbing body may be interposed between the deoxidizer and the medical container.

20 Claims, 3 Drawing Sheets

WRAPPING BODY FOR MEDICAL CONTAINER

TECHNICAL FIELD

The present invention relates to a wrapping body for a medical container. More specifically, the present invention relates to a wrapping body for a medical container which contains an infusion solution, such as a blood bag and a transfusion solution bag.

BACKGROUND ART

An anticoagulant such as an ACD solution and a CPD solution is stored in a plastic medical container such as a blood bag and a transfusion solution bag. Coagulation of blood is prevented by the action of the anticoagulant at the time of blood collection and transfusion of an infusion solution.

Such a medical container which stores an infusion solution therein is preserved in a synthetic resin sealed container for preservation. The water content in the infusion solution stored in the medical container inevitably permeates through a container wall due to the nature of the plastic material used for medical containers, and the interior of a wrapping container is kept highly humid. Microorganisms, especially fungi attached to the container surface from the time of manufacture to the time of use, tend to multiply.

In order to prevent the above drawback, a medical wrapping container is proposed wherein a deoxidizer is stored in a sealed container to prevent multiplication of fungi (Published Examined Japanese Patent Application No. 59-18066).

In this wrapping container, two polyester resin sheets overlap each other, aluminum is deposited on the opposite surfaces of the sheets, and the edges of the sheets are thermally sealed through a hot melt type adhesive, thereby providing a bag.

The bag, however, has a poor shape retention property and is inconvenient for preservation. When the bags are stacked at the time of storage or loading, the bags collapse to adversely affect the contents of the bags.

A stereoscopic wrapping container is also proposed (Published Unexamined Japanese Patent Application Nos. 58-192551 and 58-192552). Each wrapping container described in the prior art comprises a stereoscopic tray and a lid for covering an upper opening of the tray. These stereoscopic wrapping containers can provide sufficient effects, but medical containers may be moved within the trays. For this reason, pinholes may be formed in the medical containers, or tubes connected to medical containers are often twisted or entangled with each other, thus requiring time-consuming operations upon use. In addition, a pinhole may be formed at a fused portion between the lid and the tray or a portion near the fused portion upon application of an impact during loading or storage.

It is, therefore, an object of the present invention to solve the conventional problems described above and provide a wrapping body for a medical wrapping container, wherein the wrapping bodies do not collapse even if they are stacked on each other at the time of storage or loading, movement of a medical container in a wrapping container can be prevented to eliminate pinholes from the medical container or twisting or entangling of a tube connected to the medical container, and pinholes can also be eliminated from the medical container even if an impact acts thereon at the time of loading and storage.

DISCLOSURE OF INVENTION

In order to achieve the above object of the present invention, there is provided a wrapping body for a medical container comprising a tray having an upper opening, a plastic medical container which is contained in the tray together with a deoxidizer and which contains an infusion solution, and a flexible bag which has retarded permeability to a gas and steam, can contact the medical container at the upper opening of the tray, and is sealed while entirely covering the tray.

The interior of the flexible bag is preferably kept at a reduced pressure, and more preferably, at a reduced pressure of 700 to 300 mmHg.

In addition, the flexible bag is preferably sealed such that a mouth of the flexible bag is sealed above the opening of the tray.

Moreover, the flexible bag preferably has a folding margin extending 4 cm or more from the opening of the tray to the upper end of the opening of the bag.

Furthermore, the flexible bag is preferably formed by coating a flexible plastic with a resin hardly permeable to a gas and steam.

Furthermore, the resin hardly permeable to the gas and steam preferably consists of polyvinylidene chloride or an ethylene-vinyl alcohol copolymer.

Furthermore, the flexible bag preferably has transparency, and the tray also preferably has transparency.

At least one surface of the deoxidizer is covered with an air-permeable sheet, and the deoxidizer is stored so that the deoxidizer surface having the air-permeable sheet is located on the inner surface of a deoxidizer storage section. The inner surface of the storage section preferably has at least one groove which communicates with the interior of the tray.

Furthermore, according to the present invention, there is provided a medical equipment storage body characterized by comprising a container consisting of a material hardly permeable to a gas and steam, a deoxidizer located at a bottom of the container, a moisture-absorbing body which covers an upper portion of the deoxidizer and is stored in almost the entire area of the bottom of the container, and a plastic medical equipment which contains a liquid and is stored in an upper portion of the moisture-absorbing body in the container, wherein the deoxidizer, the moisture-absorbing body, and the plastic medical equipment which contains the liquid are sealed in the container.

BEST MODE OF CARRYING OUT THE INVENTION

A wrapping body for a medical container according to the present invention will be described with reference to FIGS. 1 to 4.

The wrapping body of the present invention is a wrapping body for a medical container, comprising a tray 1 having an upper opening, a plastic medical container 3 which contains an infusion solution and is housed in the tray 1 together with a deoxidizer 6, and a flexible bag 2 which has retarded permeability to a gas and steam, can contact the medical container at the opening of the tray, and is so sealed as to surround the entire tray.

The medical container 3 preserved by the wrapping body of the present invention is obtained by storing an infusion solution in a plastic (e.g., a soft vinyl chloride resin and an ethylene-vinyl acetate copolymer) container. Examples of the medical container 3 are a blood bag which stores an anticoagulant such as an ACD-A medicine (e.g., 2.20 g of sodium citrate, 0.80 g of citric acid, and 2.20 g of grape sugar are contained in 100 mg of an aqueous solution) or a CPD solution (e.g., 2.63 g of sodium citrate, 0.327 g of citric acid, 0.251 g of sodium dihydrogenphosphate, and 2.32 g of D grape sugar in 100 ml of an aqueous solution), a transfusion bag which contains an infusion solution such as a transfusion liquid, and bags which contain accessories such as tubes, connectors, and syringes molded with or connected to the blood and transfusion bags.

Figure 1:
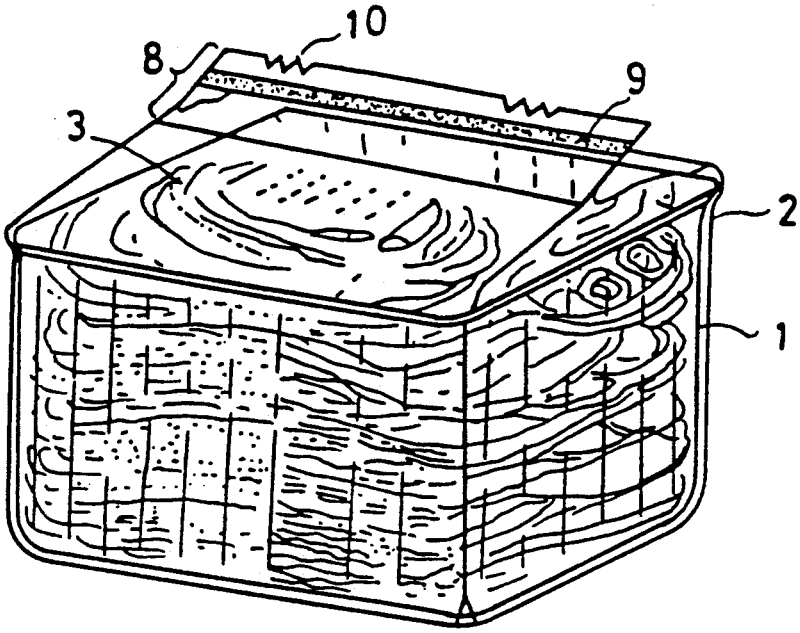
FIG. 1 is a perspective view showing an embodiment of a wrapping body for a medical container according to the present invention.
Figure 2:
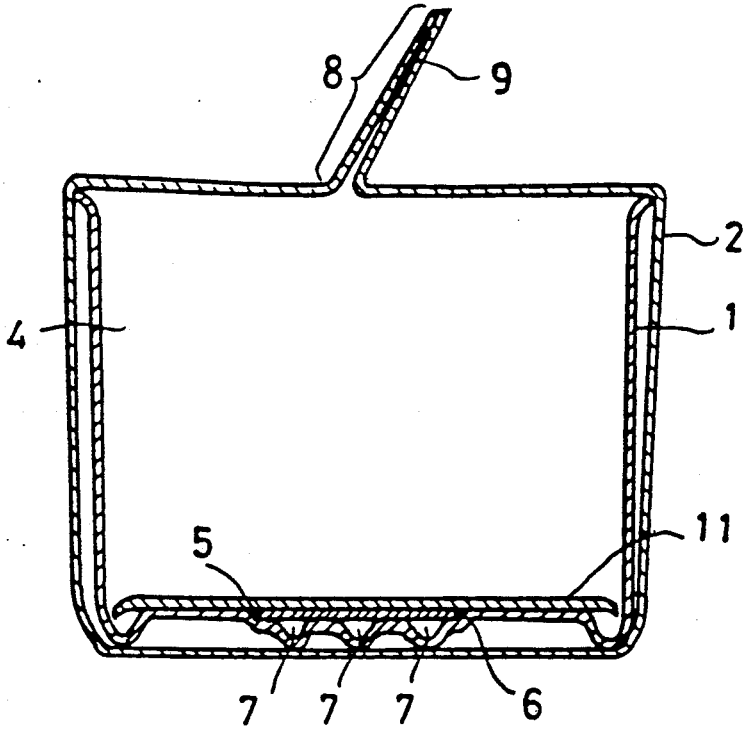
FIG. 2 is a longitudinal sectional view from which a medical container portion of the wrapping body is omitted.
Figure 3:
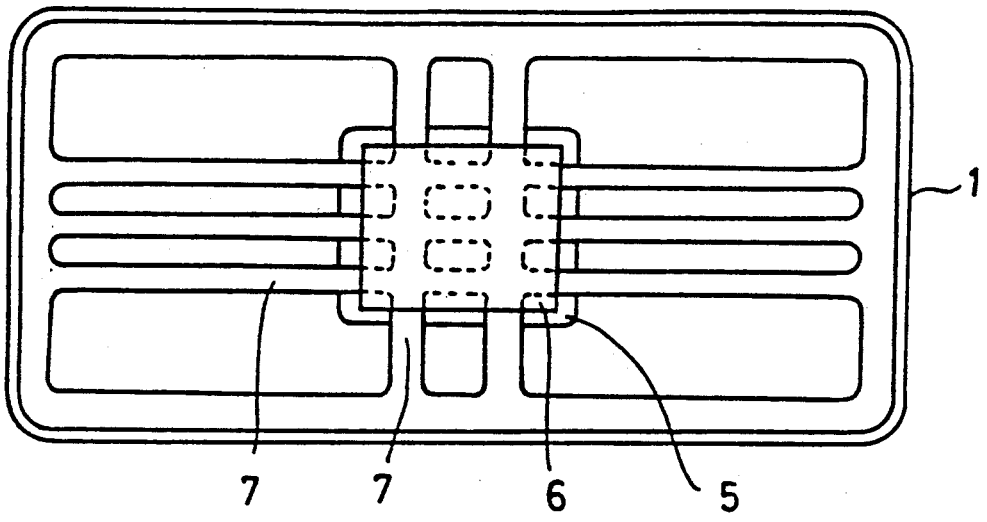
FIG. 3 is a plan view showing an arrangement of a tray used in the wrapping body of the present invention.

The tray 1 used in the wrapping body according to the present invention comprises a cage-like body having an upper open end and a predetermined depth, as shown in FIGS. 2 and 3. The tray 1 has a storage space 4 for the plastic medical container 3 which contains an infusion solution, and a deoxidizer storage portion 5 on the inner surface. The depth of the tray 1 is appropriately selected in accordance with the size and quantity of medical containers to be stored therein. The deoxidizer storage portion 5 comprises a recessed portion formed on the bottom surface of the tray 1. Grooves 7 which communicate with this recessed portion are formed. The deoxidizer storage portion may be formed on the inner wall surface of the tray 1. The deoxidizer storage portion need not be limited to the recessed portion. A rib which surrounds part of the inner surface of the tray 1 and extends inward may be formed thereby forming an inner recessed portion to serve it as the deoxidizer storage portion. A flange is preferably formed at the edge of the opening of the tray 1.

If the flange is formed at the opening edge of the tray 1, an operator will not hurt his fingers when he holds the wrapping body with his fingers upon handling.

The tray 1 preferably has a proper strength and a proper shape retention property. The proper strength is required to prevent damage during loading and transportation. The proper shape retention property is required to prevent easy deformation during handling. In addition, the tray 1 preferably has transparency because an operator can easily confirm the medical container as the content of the wrapping body. A material for the tray 1 is not limited to a specific one if it has a required strength and a required hardness For example, a vinyl chloride resin, a polypropylene resin, a polyester resin, and a polystyrene/polypropylene resin can be suitably used. In this case, these resin materials preferably have transparency.

The inner surface of the flexible bag 2 can contact the outer surface of the medical container 3 at the opening of the tray 1. The flexible bag 2 surrounds and seals the entire tray 1 with a sufficient slackening at the upper portion of the opening of the tray. The flexible bag 2 has retarded permeability for a gas and retarded permeability to steam. The retarded permeability to a gas is defined such that a gas (oxygen) permeability is 6.0 cc/m.2.24 hrs.atm (20° C., DRY) or less, and the retarded permeability to steam is defined such that a steam permeability is 3.0 g/m.2.24 hrs (40° C., 90% RH) or less. Preferably, the gas (oxygen) permeability is 1.0 cc/m.2.24 hrs.atm (20° C., DRY) or less, and the steam permeability is 1.0 g/m.2.24 hrs (40° C., 90% RH) or less.

The flexible bag 2 preferably has a tensie strength of 10 kg/15-mm width or more, a tensile elongation of 80% to 150%, a piercing strength of 1,500 g or more, a tearing strength of 10 to 150 g, a burst strength of 5 kg or more, and a heat seal property of 3.0 kg/15-mm width (seal temperature: 140° C.) or more. In addition, the flexible bag 2 preferably has transparency because an operator can easily confirm the medical container as a content of the flexible bag 2. The flexible bag 2 preferably comprises a bag obtained by coating, e.g., a resin (e.g., polyvinylidene chloride or an ethylene-vinyl alcohol copolymer) having retarded permeability for a gas and retarded permeability to steam on a surface of a flexible synthetic resin. The thickness of the coating is preferably 30 to 70 μm. The flexible synthetic resin can be polyethylene terephthalate, polyethylene (preferably oriented polyethylene), polypropylene (preferably oriented polypropylene), or the like. Particularly, the flexible synthetic resin preferably has a high adhesion strength with the resin having retarded permeability to a gas and retarded permeability to steam. The flexible synthetic resin has a thickness falling within the range of 30 to 100 μm and preferably 35 to 60 μm and is preferably transparent. As a more preferable form of the flexible bag 2, a resin (polyvinyl chloride or an ethylene-vinyl alcohol copolymer) having retarded permeability to a gas or retarded permeability to steam is coated on the outer surface of a flexible film of polyethylene terephthalate, oriented polyethylene, oriented polypropylene, or the like, an anti-impact resin layer (e.g., oriented polyamide) is laminated on the inner surface of the flexible film through an adhesive to provide an anti-impact property (anti-pinhole properly) to the inner surface, and a hot melt adhesive layer (e.g., low-density polyethylene) for improving a heat seal property is laminated on the anti-impact resin layer through an adhesive. Alternatively, a resin (e.g., polyvinylidene chloride and an ethylene-vinyl alcohol copolymer) having retarded permeability for a gas and retarded permeability to steam is coated on the outer surface of a flexible film of oriented polyethylene, oriented polypropylene, or the like, and high-density polyethylene and/or polyethylene terephthalate are/is coated thereon. A hot melt type adhesive layer (e.g., low-density polyethylene) is laminated on the inner surface of the flexible film.

The flexible bag 2 has an opening for receiving the tray 1 which contains the medical container. After the tray 1 is stored in the flexible bag 2, a weld 9 is formed by heat, ultrasonic power, or high-frequency power to seal the opening. The opening may be sealed by an adhesive, but preferable sealing is as described above.

Notches 10 are formed at end portions of the flexible bag at a position above the opening of the tray 1 so as to allow easy opening of the flexible bag 2. The flexible bag is sealed at an upper, side, or bottom portion of the tray.

The flexible bag 2 is sealed with a sufficient slackening between the flexible bag 2 and the upper portion of the opening of the tray 1. The inner surface of the flexible bag can contact the surface of the medical container due to the following reason. When the interior of the wrapping body is set at a negative pressure because oxygen in the wrapping body is absorbed by a deoxidizer to be described later, or when the interior of the wrapping body is set at a reduced pressure beforehand, a portion of the flexible bag 2 at the upper portion of the tray 1 is deformed toward the inside of the tray 1 to hold the medical container stored therein in a direction of the bottom portion of the tray 1, thereby preventing movement of the medical container.

A distance between the opening of the tray of the flexible bag 2 and the upper bag end above the opening is preferably 4 cm or more. More specifically, a folding margin 8 of 4 cm or more and preferably 6 cm or more is preferably formed between the sealed end portion of the flexible bag 2 and the upper portion of the tray 1 when the flexible bag 2 is fully extended. This is because dust can be prevented from dropping on the surfaces of remaining medical containers by folding the margin 8 when the wrapping body stores a plurality of medical containers and they are not used at once.

The deoxidizer 6 stored in the deoxidizer storage portion 5 of the tray 1 is used to prevent absorption of oxygen inside the wrapping body and production of fungi. The deoxidizer 6 is also used to set the interior of the wrapping body at a negative pressure and deform the upper portion of the flexible bag 2 above the tray 1 toward the inside of the tray 1, so that the medical container is held in the direction of the bottom portion of the tray 1 to prevent movement of the medical container. Various types of deoxidizers can be used. Its examples are an oxygen absorbing agent (Published Unexamined Japanese Patent Application No. 54-37088) consisting of a metal halide (containing water as needed) and at least one compound selected from the group consisting of iron carbide, iron carbonyl, ferrous oxide, ferrous hydroxide, and silicon iron, and an oxygen absorbing agent (Published Unexamined Japanese Patent Application No. 54-35189) formed by coating a metal powder with a metal halide. At least one surface of the deoxidizer 6 is preferably coated with an air-permeable sheet. The deoxidizer is stored in the deoxidizer storage portion 6 of the tray 1 so that the deoxidizer surface having the air-permeable sheet is located on the inner surface of the deoxidizer storage portion of the tray 1 and the deoxidizer surface having a non-air-permeable sheet is directed toward the medical container storage space of the tray 1. The grooves 7 of the tray 1 are formed to cause the air-permeable sheet side of the deoxidizer to always communicate with the internal space of the tray 1.

The deoxidizer can perfectly function even if a medical container is stored even above the deoxidizer and can sufficiently absorb oxygen inside the wrapping body.

A moisture-absorbing sheet having a size almost equal to the bottom surface of the tray 1, e.g., Japan paper 11, is preferably placed above the deoxidizer due to the following reason. Even if the water content flows from a medical container to form water droplets, these droplets can be absorbed by the Japan paper 11. Therefore, degradation of the deoxidizing function upon absorption of the water droplets into the deoxidizer can be prevented.

The interior of the flexible bag 2 which stores the tray 1 having a medical container therein, i.e., the interior of the wrapping body of the present invention, is preferably set at a reduced pressure.

The amount of oxygen inside the wrapping body can be reduced by the reduced pressure, and the interior of the wrapping body can be set in a deoxidized state by the deoxidizer and hence a small amount of deoxidizer. Formation of fungi can be perfectly prevented.

Figure 5:
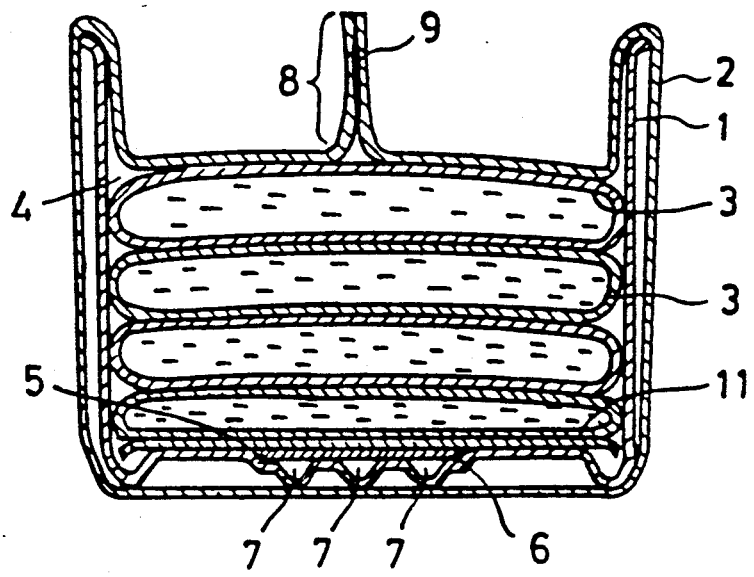
FIG. 5 is a sectional view showing a wrapping body according to another embodiment of the present invention.

Although pressure reduction can be positively performed, the interior of the tray can be naturally set in a reduced-pressure state over time. As shown in FIG. 5, the upper portion of the flexibe bag 2 above the tray 1 is deformed toward the inside of the tray 1, and the stored medical container is held in the direction of the bottom portion of the tray 1, thereby perfectly preventing movement of the medical container. The reduced pressure is preferably set to be 700 to 300 mmHg.

The wrapping body according to the present invention will be described by way of its examples.

EXAMPLE 1

The following tray was formed. It was made of vinyl chloride resin and had a flange along an edge of an upper opening and a height of 110 mm. The upper opening had a length of 250 mm and a width of 145 mm. A bottom surface of the tray had a length of 245 mm and a width of 135 mm (differences between the lengths and widths of the upper opening and the bottom surface define the size of the flange). As shown in FIG. 3, the bottom surface had the deoxidizer storage portion constituted by the recess, and grooves which communicated with the storage portion.

Figure 4:
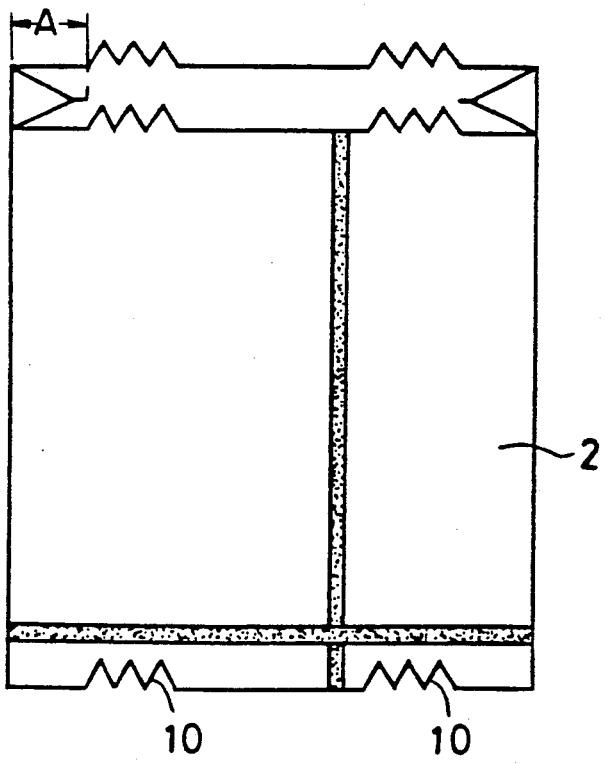
FIG. 4 is a view showing an arrangement of a flexible bag used in the wrapping body of the present invention.

A flexible bag had the shape shown in FIG. 4. The flexible bag had a length of 385 mm and a width of 230 mm, and a width A of each side margin was 15 mm. A material of the flexible bag (total thickness: about 108 $\mu$) was prepared such that polyvinylidene chloride was coated on the outer surface of a flexible film consisting of polyethylene terephthalate, oriented polyamide (thickness: about 15 $\mu$) was laminated on the polyvinylidene chloride through an adhesive, and low-density polyethylene (thickness: about 70 $\mu$) was laminated on the oriented polyamide through an adhesive, the resultant films were thermally sealed at the bottom and side portions, thereby obtaining a bag. In addition, notches were formed at the lower end.

The oxygen permeability of this flexible bag was 1.90 cc/cm$^2$.hrs.atm (20° C., DRY), and its steam permeability was 0.55 g/m$^2$.24 hrs (40° C., 90% RH). The flexible bag had a tensile strength of 11.5 kg/15-mm width, a tensile elongation of 102.5%, a piercing strength of 2,140 g, a tearing strength of 85 g, a burst strength of 8.1 kg, and a heat seal property of 10.9 kg/15-mm width (seal temperature: 140° C.).

A deoxidizer (Ageless (tradename) available from MITSUBISHI GAS CHEMICAL CO., LTD.), one surface of which was covered with an air-permeable sheet and the other surface of which was covered with a non-air-permeable sheet was stored in the deoxidizer storage portion of the tray such that the air-permeable sheet side of the deoxidizer was located on the bottom surface side of the tray. Japan paper having almost the same size as that of the bottom surface of the tray was placed on the deoxidizer, and 10 blood bags (blood collection bags for double plasmapharesis) were placed in the tray.

At this time, a distance between the upper end of the uppermost blood bag and the opening of the tray was about 12 mm.

The tray which contained the blood bags was placed in the flexible bag, and the opening of the flexible bag was thermally sealed at the lower portion of the tray with a minimum amount of air left in the bag, thereby preparing a wrapping body having notches at its edge portions.

At this time, the flexible bag was sufficiently slackened above the opening of the tray, and the inner surface of the flexible bag contacted the medical containers upon depression of the flexible bag. A length (folding margin) from the opening of the tray to the upper portion of the flexible bag was 40 mm.

When this wrapping body was left to stand for about 24 hours, the flexible bag was deformed inward from the opening of the tray and held the medical containers. At this time, even if the wrapping body was shaken, the medical containers stored therein were not easily moved.

Even if an external force was applied to spread and deform the opening portion of the tray, the flexible bag was spread above the tray, and no excessive force acted on any part of the tray. The wrapping body seemed to have a sufficient anti-impact property. The flexible bag could be easily opened by tearing it from the removed from the tray, and the folding margin could be folded to easily seal the wrapping body.

EXAMPLE 2

A material of a flexible bag (total thickness: about 121 $\mu$) was prepared as follows. Polyvinylidene chloride was coated on the outer surface of a flexible film consisting of oriented polypropylene, oriented polyamide (thickness: about 15 $\mu$) was laminated on the inner surface of the flexible film through an adhesive, and low-density polyethylene (thickness: about 70 $\mu$) was laminated on the oriented polyamide through an adhesive. The oxygen permeability of this flexible bag was 2.90 cc/cm$^2$.hrs.atm (20° C., DRY), and its steam permeability was 0.49 g/m.2.24 hrs (40° C., 90% RH). The flexible bag had a tensile strength of 12.8 kg/15-mm width, a tensile elongation of 93.0%, a piercing strength of 2,270 g, a tearing strength of 75 g, a burst strength of 9.1 kg, and a heat seal property of 10.1 kg/15-mm width (seal temperature: 140° C.). A wrapping body was prepared following the same procedures as in Example 1 except for the flexible bag. At this time, the flexible bag was sufficiently slackened above the opening of the tray, and the inner surface of the flexible bag contacted the medical containers upon depression of the flexible bag. A folding margin was 45 mm.

When this wrapping body was left to stand for about 30 hours, the flexible bag was deformed inward from the opening of the tray and held the medical containers At this time, even if the wrapping body was shaken, the medical containers stored therein were not easily moved.

Even if an external force was applied to spread and deform the opening portion of the tray, the flexible bag was spread above the tray, and no excessive force acted on any part of the tray. The wrapping body could be easily sealed by using the folding margin as in Example 1.

[EXAMPLE]

Materials as in Example 1 were used, and a sealed wrapping body was prepared after the interior of the flexible bag was set at a reduced pressure. The reduced pressure was 600 mmHg.

When the wrapping body was prepared, the flexible bag was already deformed inward from the opening of the tray so as to hold medical containers. The medical containers stored inside the wrapping body were not easily moved even if the wrapping body was shaken. Even if an external force was applied to spread and deform the opening portion of the tray, the flexible bag was spread above the tray, and no excessive force acted on any part of the tray. The wrapping body was easily sealed by using the folding margin as in Example 1.

[COMPARATIVE EXAMPLE]

A wrapping body was prepared following the same procedures as in Example 1 except that a flexible bag had a length of 350 mm.

The flexible bag had almost no slackening above the opening of the tray Even if the flexible bag was depressed, the bag did not contact a medical container. Almost no folding margin was provided.

Although this wrapping body was left to stand for about 24 hours, the flexible bag underwent almost no inward deformation inside the opening of the tray. When the wrapping body was shaken, the medical container inside the wrapping body was freely moved.

When an external force was applied to spread and deform the opening portion of the tray, a pinhole was formed at a heat seal portion of the flexible bag above the tray.

The wrapping body according to the present invention is a wrapping body for a medical container comprising a tray having the opening, a plastic medical container which is contained in the tray together with a deoxidizer and which contains an infusion solution, and a flexible bag which has retarded permeability to a gas and steam, can contact the medial container at the upper opening of the tray, and is sealed while entirely covering the tray. Since the trya having a shape retention property is used, the wrapping bodies do not collapse upon stacking during storage and loading. In addition, the interior of the wrapping body is set at a negative pressure by the deoxidizer stored therein, and the upper portion of the flexible bag above the tray is deformed toward the inside of the tray to hold the medical container in the direction of the bottom portion of the tray, thereby preventing movement of the medical container inside the wrapping body. Therefore, pinholes will not be formed in the medical container, or a tube connected to the medical container will not be twisted or entangled. In addition, during loading or storage, even if an impact acts on the wrapping body, it is absorbed by the slackening of the flexible bag, and pinholes will not be formed in the wrapping body.

Industrial Applicability

The present invention is effective to wrap a plastic container which contains an infusion solution, such as a blood or transfusion bag without causing formation or multiplication of microorganisms such as fungi and without any damage upon reception of an impact during loading.

What is claimed is:

1. A wrapping body for a medical container, comprising:

a tray having an opened upper portion;

a plastic medical container which is contained in said tray together with a deoxidizer and which contains an infusion solution;

a flexible bag enclosing said tray and having a retarded permeability to a gas and steam, said bag being sized and disposed so that the bag can be contacted with said medical container at the opened upper portion of said tray; and means sealing said bag while said bag entirely covers said tray.

2. A wrapping body for a medical container according to claim 1, including means wherein an interior of said flexible bag is kept at a reduced pressure.

3. A wrapping body for a medical container according ot claim 2, wherein the reduced pressure is 700 to 300 mmHg.

4. A wrapping body for a medical container according to claim 1; wherein an opening of said flexible bag is sealed above the opening of said tray.

5. A wrapping body for a medical container according to claim 1; wherein a length of said flexible bag from the opening of said tray to an upper end of said flexible bag is not less than 4 cm.

6. A wrapping body for a medical container according to claim 1, wherein said flexible bag comprises a flexible plastic member on which is coated a resin having retarded permeability to a gas and steam.

7. A wrapping body for a medical container according to claim 6, wherein the resin having retarded permeability to the gas and steam is polyvinylidene chloride.

8. A wrapping body for a medical container according to claim 1; wherein said flexible bag has transparency.

9. A wrapping body for a medical container according to claim 1; wherein said tray has transparency.

10. A wrapping body for a medical container according to claim 1; wherein at least one surface of said deoxidizer is covered with an air-permeable sheet, and said deoxidizer is stored such that an air-permeable sheet side of said deoxidizer is located on an inner surface of a deoxidizer storage portion formed on an inner surface of said tray, said inner surface of said deoxidizer storage portion having at least one groove which communicates with an interior of said tray.

11. A medical equipment storage body, comprising:

a container made of a material having retarded permeability to a gas and steam;

a deoxidizer located at a bottom portion of said container;

a moisture-absorbing body stored in a substantially entire area of a bottom portion of said container to cover an upper portion of said deoxidizer; and a plastic medical equipment which contains a liquid and which is stored on an upper portion of said moisture-absorbing body in said container;

wherein said deoxidizer, said moisture-absorbing body, and the plastic medical equipment which contains the liquid are sealed in said container.

12. A wrapping body for a medical container according to claim 6, wherein the resin having retarded permeability to the gas and steam is an ethylene-vinyl alcohol copolymer.

13. A wrapping body for a medical container, comprising:

a tray having an opened upper portion which defines an upper opening;

at least one plastic medical container contained in said tray together with a deoxidizer and which contains an infusion solution;

a flexible bag enclosing said tray and having a retarded permeability to a gas and steam, said bag being sized and disposed so that the bag can be contacted with said at least one medical container at the upper opening of said tray; and means sealing said bag while said bag entirely covers said tray;

said tray having a depth so that an edge of the upper opening of said tray is higher than an upper surface of an uppermost medical container stored therein; and said flexible bag being dimensioned so as to be in contact with an upper surface portion of said uppermost medical container with a slackening at an upper portion of the upper opening of said tray.

14. A wrapping body for a medical container according to claim 13, including means wherein an interior of said flexible bag is kept at a reduced pressure.

15. A wrapping body for a medical container according to claim 14, wherein the reduced pressure is 700 to 300 mmHg.

16. A wrapping body for a medical container according to claim 13, wherein an opening of said flexible bag is sealed above the opening of said tray.

17. A wrapping body for a medical container according to claim 13, wherein a length of said flexible bag from the opneing of said tray to an upper end of said flexible bag is not less than 4 cm.

18. A wrapping body for a medical container according to claim 13, wherein said flexible bag comprises a flexible plastic member on which is coated a resin having retarded permeability to a gas and steam.

19. A wrapping body for a medical container according to claim 18, wherein the resin having retarded permeability to the gas and steam is polyvinylidene chloride.

20. A wrapping body for a medical container according to claim 18, wherein the resin having retarded permeability to the gas and steam is an ethylene-vinyl alcohol copolymer.

* * * * *